US005609223A

United States Patent [19]

Iizaka et al.

[11] Patent Number: 5,609,223

[45] Date of Patent: Mar. 11, 1997

[54] CHECKOUT SYSTEM WITH AUTOMATIC REGISTRATION OF ARTICLES BY BAR CODE OR PHYSICAL FEATURE RECOGNITION

[75] Inventors: Hitoshi Iizaka, Fuji; Masahito Sano; Yasuo Matsumoto, both of Numazu, all of Japan

[73] Assignee: Kabushiki Kaisha TEC, Shizuoka, Japan

[21] Appl. No.: 451,278

[22] Filed: May 30, 1995

[30] Foreign Application Priority Data

May 30, 1994 [JP] Japan ..... 6-116841

[51] Int. Cl.[6] ..... A47F 10/02

[52] U.S. Cl. ..... 186/61; 235/383

[58] Field of Search ..... 186/61; 235/383

[56] References Cited

U.S. PATENT DOCUMENTS

| | | | |
|---|---|---|---|
| 4,676,343 | 6/1987 | Humble et al. | 186/61 |
| 4,792,018 | 12/1988 | Humble et al. | 186/61 |
| 4,920,255 | 4/1990 | Gabeler | 235/454 |
| 4,939,355 | 7/1990 | Rando et al. | 235/467 |
| 5,010,242 | 4/1991 | Frontino | 235/467 |
| 5,019,694 | 5/1991 | Collins | 186/61 X |
| 5,115,888 | 5/1992 | Schneider | 186/61 |
| 5,386,107 | 1/1995 | Dvorkis et al. | 235/472 |
| 5,426,282 | 6/1995 | Humble | 186/61 |

FOREIGN PATENT DOCUMENTS 4-67291 3/1992 Japan .

*Primary Examiner*—F. J. Bartuska

*Attorney, Agent, or Firm*—Frishauf, Holtz, Goodman, Langer & Chick

[57] ABSTRACT

A checkout system has a checkout lane which includes a belt conveyor for carrying articles in one direction a video camera for imaging an article which is being carried by the belt conveyor, and a bar code scanner for reading out a bar code of the article which is being carried by the belt conveyor. A CPU recognizes and registers the article on the basis of at least one of the bar code read out by the bar code scanner and the physical features of the article which are included in an image obtained by the video camera.

14 Claims, 10 Drawing Sheets

CHECKOUT SYSTEM WITH AUTOMATIC REGISTRATION OF ARTICLES BY BAR CODE OR PHYSICAL FEATURE RECOGNITION

BACKGROUND OF THE INVENTION

1. Field of the Invention

This invention relates to a checkout system for recognizing an article based on the article code affixed to the respective article.

2. Description of the Related Art

In general, large-scale stores such as supermarkets utilize Point of Sales (POS) systems to enhance the rationalization of service. For example, a checkout apparatus used as a terminal of the POS system is disclosed in Jpn. Pat. KOKAI Publication No. 4-67291. In this type of checkout apparatus, as shown in FIG. 1, a bar code scanner 1 is arranged between a carry-in conveyor 2 and a carry-out conveyor 3 and an electronic cash register 4 is disposed near one side of the carry-out conveyor 3. The bar code scanner 1 has a keyboard 1*a* for inputting an article code and a display 1*b* for displaying the result of inputting.

When a customer 10 comes to the carry-in conveyor 2 side while pushing a shopping cart 11 in which to-be-purchased articles are received, the customer places the articles on the carry-in conveyor 2 one by one and then moves towards the carry-out conveyor 3 as indicated by an arrow. The carry-in conveyor 2 sequentially carries the articles placed one at a time by the customer 10 towards the bar code scanner 1. An article sensor 5 detects an article carried to the end portion of the carry-in conveyor 2 which is adjacent to the bar code scanner 1. The carry-in conveyor 2 stops at the time of detection of the article and is driven again to carry the next article after the article is taken up from the carry-in conveyor 2 by an operator 6. The operator 6 puts the article in a scanning range of the bar code scanner 1 so as to permit the bar code scanner 1 to read the article code affixed to the taken-up article in the bar code form. If the article code is not affixed to the article or the bar code scanner 1 fails to read the article code, the article code is input to the bar code scanner 1 by use of the keyboard 1*a*. The carry-out conveyor 3 carries the article placed thereon by the operator in a direction away from the bar code scanner 1. The electronic cash register 4 registers the sales article based on the article code supplied from the bar code scanner 1, derives the total sum of money for all of the sold articles when the operator 8 operates the total key, and issues a receipt having the total sum of money printed thereon. The customer 10 pays money for the articles to the operator 8, moves the purchased articles from the carry-out conveyor 3 into the shopping cart 11, and then leaves the checkout apparatus. The driving speeds of the carry-in conveyor 2 and carry-out conveyor 3 can be adjusted by use of control switches 7 and 9 which are respectively disposed near the operators 6 and 8.

In the above checkout apparatus, a partition rod 12 is used to separate the purchased articles for respective customers 10 and previously placed near the carry-in conveyor 2. The customer 10 puts the partition rod 12 on the carry-in conveyor 2 after all of the articles purchased by the customer are placed. The operator 6 moves the partition rod 12 from the carry-in conveyor 2 to the carry-out conveyor 3 and the operator 8 recognizes that the partition rod 12 is carried on the carry-out conveyor 3 and then operates the total key of the electronic cash register 4.

However, since the above checkout apparatus is so constructed that two workers are engaged as operators for the bar code scanner 1 and the electronic cash register 4, it is sometimes difficult to increase the number of checkout apparatuses when taking the labor cost into consideration. Further, in the above checkout apparatus, a troublesome operation that the partition rod 12 which has been moved to the carry-out conveyor side must be moved back to the carry-in conveyor side is required.

SUMMARY OF THE INVENTION

An object of this invention is to provide a checkout system in which the number of operators required for rapidly and stably registering articles can be reduced without increasing the load of the operator.

According to a first aspect of the present invention, a checkout system had a checkout lane comprising carrying means for carrying articles in one direction; imaging obtaining means for obtaining an image of an article which is being carried by said carrying means; reading means for reading out a bar code affixed to an article which is being carried by said carrying means; and registering means for recognizing the article on the basis of one of (i) the bar code read out by said reading means, and (ii) physical features of the article which are included in the article image obtained by said image obtaining means, and then automatically registering the article.

According to another aspect of the invention, a checkout system comprises a checkout lane including carrying means for carrying articles in one direction, feature extraction means for extracting a feature of an article carried by said carrying means, and article registering means for recognizing and registering an article based on the feature of the article extracted by said feature extraction means; and a remote terminal device disposed at a position apart from said checkout lane, for displaying a feature of an article which cannot be recognized by said article registering means of said checkout lane and permitting an article having the displayed feature to be designated by a key input operation. The article registering means including auxiliary registering means for registering an article designated by said remote terminal device; and the checkout lane includes instruction inputting means for inputting a start and an end instruction of article registration, counting means for counting a number of articles which is conveyed into a predetermined area after the start instruction is input by said inputting means and for counting a number of articles which have been registered, and completion detecting means for detecting completion of article registration by confirming that the numbers of conveyed articles and registered articles counted by said counting means coincide with each other after the end instruction is input by said instruction inputting means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

There will now be described a checkout system according to a first embodiment of this invention with reference to the accompanying drawings.

Figure 1:
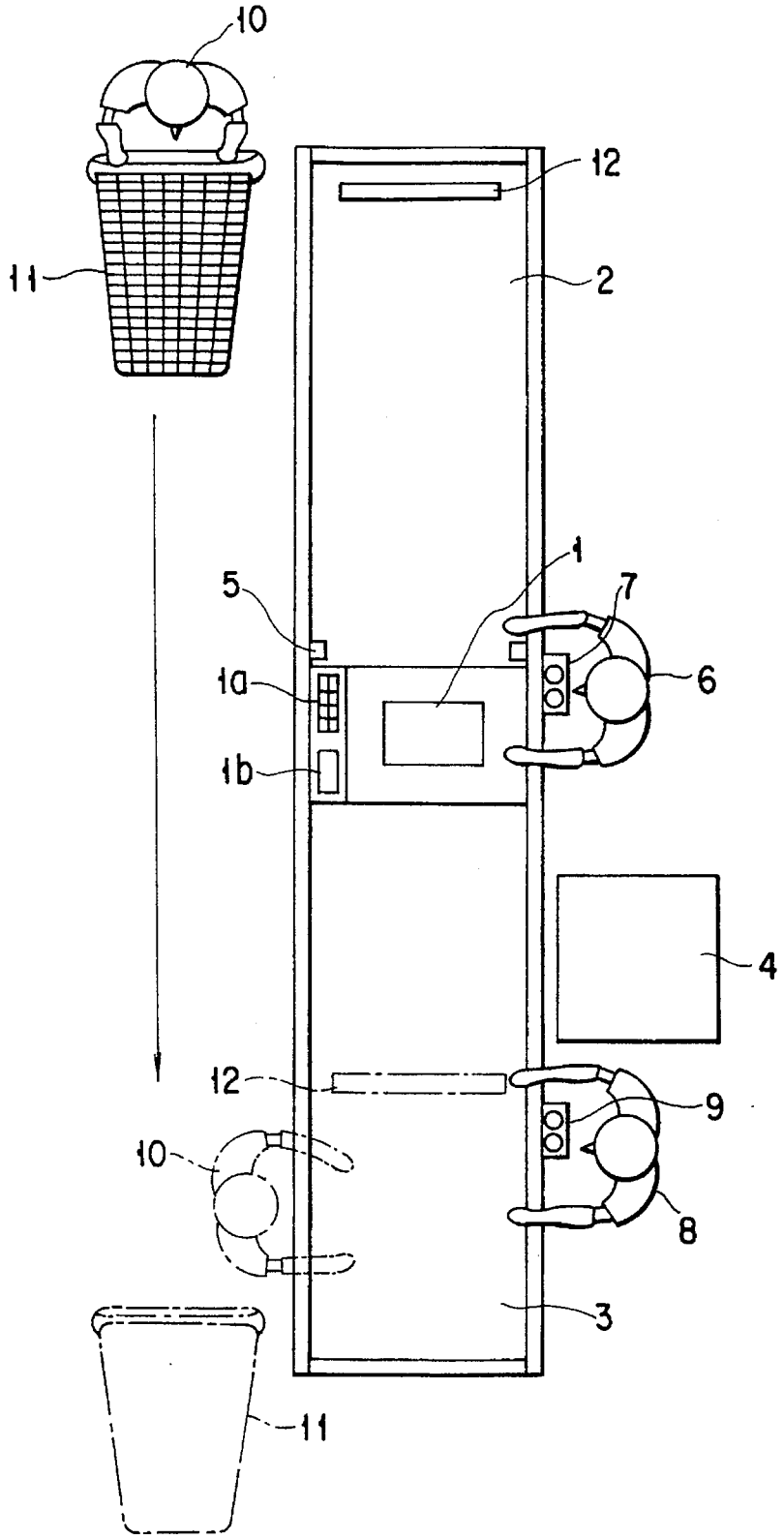
F I G. 1 (PRIOR ART)
FIG. 1 is a view showing one example of the conventional checkout system.
Figure 2:
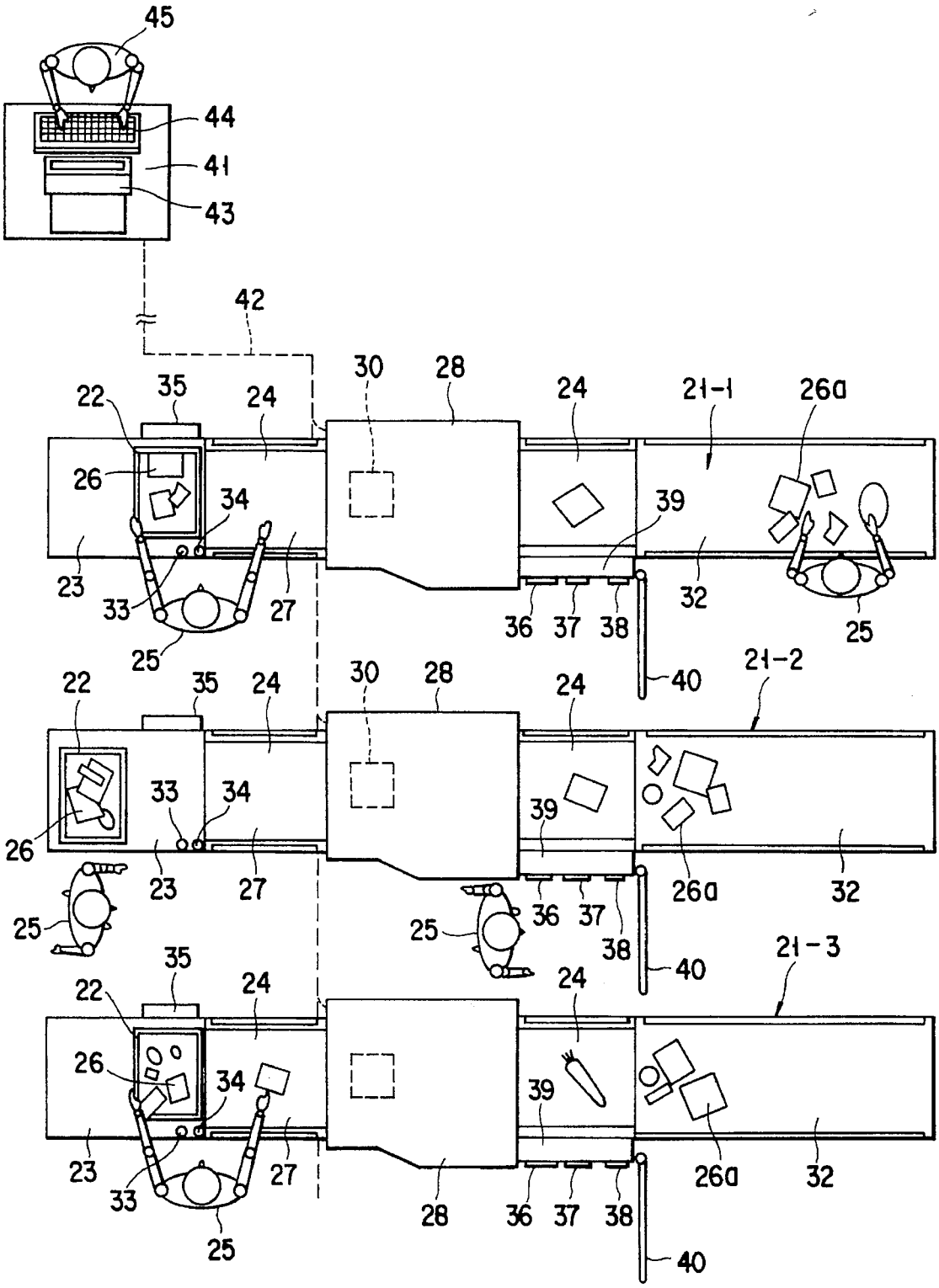
FIG. 2 is a whole construction view showing a first embodiment of a checkout system according to this invention.

FIG. 2 shows a checkout system according to a first embodiment of this invention. For example, the checkout system has three checkout lanes 21-1, 21-2 and 21-3 and a remote terminal device 41 arranged at a preset distance from the checkout lane. Each of the checkout lanes 21-1, 21-2 and 21-3 and the remote terminal device 41 are connected via a line 42 and signals and image data are transferred via the line 42.

On each of the checkout lanes 21-1, 21-2 and 21-3, a basket placing table 23 for placing a shopping basket 22 thereon, a belt conveyor 24 for carrying an article 26 from the upstream side to the downstream side, and an article stacker 32 for storing an article 26*a* carried are sequentially arranged from one end of the checkout lane.

An article placing area 27 for permitting a customer 25 to take out an article 26 from the shopping basket 22 and place the article on the area is provided on the upstream side portion of the belt conveyor 24. Further, on the intermediate portion of the belt conveyor 24, a tunnel portion 28 is provided. In the tunnel portion 28, a height measuring apparatus 29 for measuring the height of an article, a video camera 30 for obtaining an image of an article carried by the belt conveyor 24 and a bar code scanner 31 having a variable scanning optical system for reading a bar code affixed on the article are arranged as shown in FIG. 5.

Figure 6:
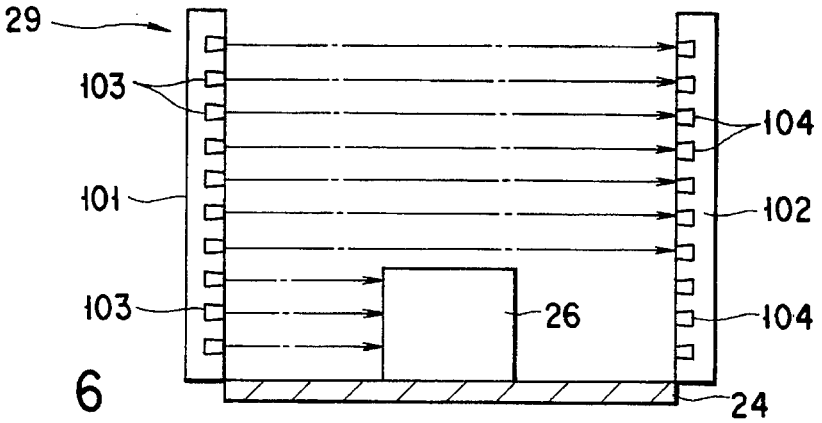
FIG. 6 is a view showing the structure of a height measuring apparatus shown in FIG. 5.

As shown in FIG. 6, the height measuring apparatus 29 has two support poles 101 and 102 arranged to face each other with the belt conveyor 24 as a carrying path for the article 26 disposed therebetween. The support pole 101 has a plurality of light emitting elements 103, - - - 3 formed of LEDs or the like arranged at a preset pitch. The other support pole 102 has a plurality of light receiving elements 104, - - - formed of photo-transistors or photodiodes arranged at a preset pitch to face the respective light emitting elements 103, - - - . In the height measuring apparatus 29, light beams emitted from the light emitting elements 103 towards the light receiving elements 104 are interrupted by the article 26 carried on the belt conveyor 24 and the height of the article 26 can be measured based on the number of light receiving elements 104 which cannot receive the light beam.

Figure 5:
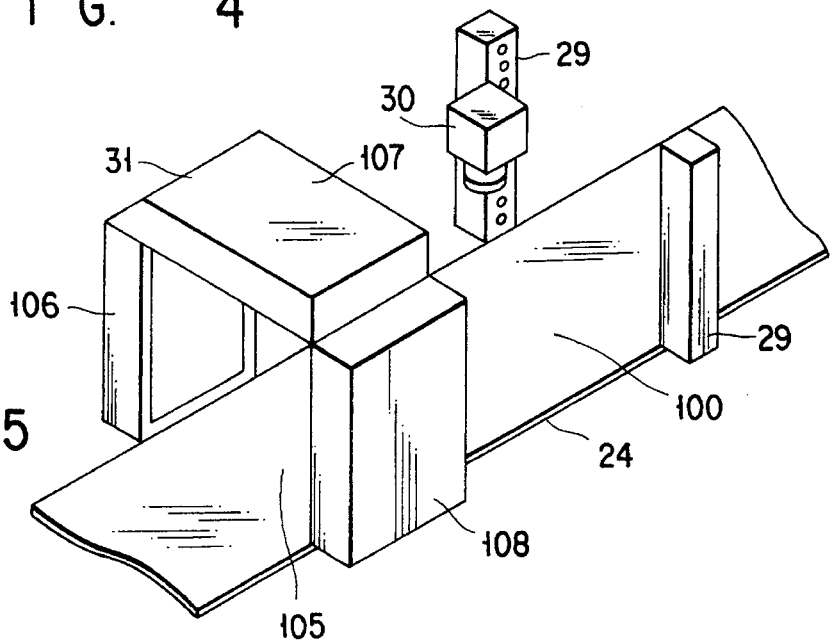
FIG. 5 is a perspective view showing the internal structure of a tunnel portion.

As shown in FIG. 5, the video camera 30 is arranged directly above an image input area 100 to monitor the entire portion of the image input area 100 on the belt conveyor 24 or obtain an image of an article passing through the image input area 100. The features of an article such as the position, size, shape and color of the article can be extracted by subjecting the image of the article obtained by the video camera 30 to the image processing. At this time, the position and inclination of the bar code affixed on the article are detected.

As shown in FIG. 5, the bar code scanner 31 reads the bar code affixed to an article passing through a scanning area 105 on the belt conveyor 24 and decodes article code information. The bar code scanner 31 has variable scanning optical systems 106, 107, 108 including laser light sources such as semiconductor lasers arranged on both sides of and above the scanning area 105. The optical length, focal distance and scanning pattern of the variable scanning optical systems 106, 107, 108 can be changed. Therefore, the variable scanning optical systems 106, 107, 108 can selectively and concentratedly scan a portion including the bar code affixed to the article based on the result of height measurement by the height measuring apparatus 29 and results obtained by processing the image from the video camera 30 so as to rapidly and stably read the bar code. The article code information decoded by the bar code scanner 31 is registered into the POS terminal as will be described later.

Further, as shown in FIG. 2, a start button 33 for indicating that the placement of the article is started and an end button 34 for indicating that the placement of the article is ended are disposed on one corner portion of the basket placing table 23. A panel display 35 for displaying the contents of the operation for the customer is disposed on one side of the basket placing table 23 opposite to the customer 25. Further, a speaker for informing the guidance in a voice is also disposed on one corner portion of the basket placing table 23.

An Automatic Tellet's Machine (ATM) 39 is disposed on the side of the passage for the customer 25 on the downstream side of the belt conveyor 24 provided in each of the checkout lanes 21-1, 21-2, 21-3. The ATM 39 has a sub-total display 36 for displaying the total sum of money for the registered articles 26*a*, an automatic payment machine 37 having an insertion port into which a pre-paid card, credit card or cash is inserted, for effecting the automatic payment process and giving back a change from a change discharging port if the payment is made by cash and a change is made, and a receipt issuing machine 38 for printing the article names and prices of the registered articles, the number of articles and the total amount of money on paper and issuing a receipt. A gate 40 is disposed on the passage of each of the checkout lanes 21-1, 21-2, 21-3. The gate 40 is disposed on the passage in a boundary portion between the downstream side of the belt conveyor 24 and the article stacker 32 for storing the registered articles. The gate 40 is normally set in a state to block up the passage and locked in this state. The gate 40 is released from the locked state when the customer 25 has made the payment by use of the automatic payment machine 37 and the receipt issuing machine 38 has issued a receipt, and after the customer has passed through the gate in the lock releasing state, the gate is closed again to block up the passage and locked in this state.

As shown in FIG. 2, the remote terminal device 41 disposed in a preset position has a monitor display 43 for receiving image data of unregistered articles from each of the checkout lanes 21-1, 21-2, 21-3 and displaying the image data, a keyboard 44 for inputting the article name or article code of the article displayed on the monitor display 43, and an alarming device for receiving an alarm signal from each of the checkout lanes 21-1, 21-2, 21-3 and effecting the alarming operation. The remote terminal device 41 is operated by the operator 45. For example, as the alarming device, a sound generation device having a speaker, a indicator or a device for displaying an alarm message on the monitor display 43 is used.

Figure 3:
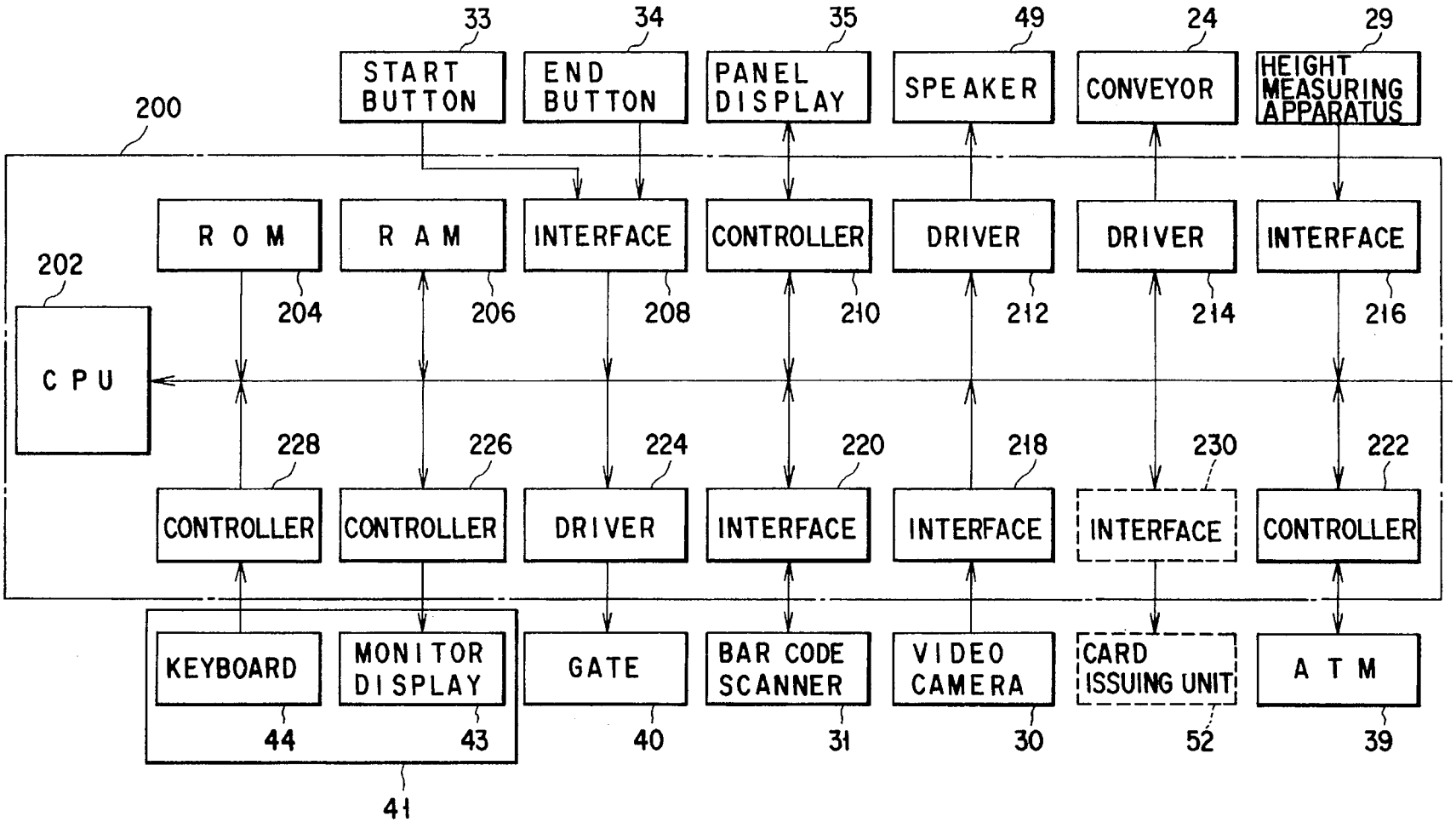
FIG. 3 is a block diagram showing the construction of a checkout lane and remote terminal device shown in FIG. 2.

FIG. 3 shows a Point of Sales (POS) terminal 200 contained in each of the checkout lanes 21-1, 21-2, 21-3. The POS terminal 200 has a memory for registering or accumulating the number of sold articles and the amount of money of the sold articles based on article code information decoded by the bar code scanner 31. Further, the POS terminal 200 is connected to a host computer set in an office of the store, for example, and all the sales information in the store is managed by use of the host computer. Further, the POS terminal 200 also functions as a control circuit for controlling the components of the corresponding checkout lane 21-1, 21-2, 21-3.

Figure 4:
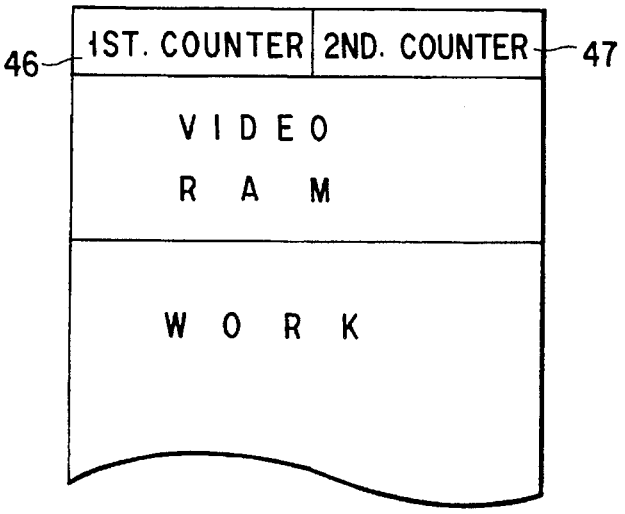
FIG. 4 is a diagram schematically showing an area in a RAM connected to a CPU shown in FIG. 3.

That is, the POS terminal 200 has a CPU 202 for controlling the components of the checkout lane. The CPU 202 is connected to a ROM 204 in which initialization data and control programs for the components are stored and a RAM 206 having a first counter 46, second counter 47, video RAM area and work area as shown in FIG. 4. The start button 33 and end button 34 disposed on the upstream side of the belt conveyor 24 are connected to the CPU 202 via an interface 208. Further, the panel display 35 and speaker 49 are connected to the CPU 202 via a controller 210 and driver 212, respectively. The conveyor 24 is connected to the CPU 202 via a driver 214. The height measuring apparatus 29, video camera 30 and bar code scanner 31 of the tunnel portion 28 disposed near the intermediate portion of the conveyor 24 are connected to the CPU 202 via respective interfaces 216, 218, 220. The ATM 39 and gate 40 disposed on the downstream side of the conveyor 24 are connected to the CPU 202 via a controller 222 and driver 224, respectively.

On the other hand, the monitor display 43 and keyboard 44 of the remote terminal device 41 are connected to a CPU 202 of the POS terminal 200 via respective controllers 226, 228.

Next, the operation of the checkout system of this invention is explained with reference to FIGS. 2 and 7.

The CPU 202 provided in the POS terminal 200 of each of the checkout lanes 21-1, 21-2, 21-3 causes the panel display 35 to display the guidance for the start of the operation for the customer, starts to drive the belt conveyor 24 and clears the content of the first counter (Sl) when the start button 33 is depressed by the customer 25.

Then, an article 26 is placed on the article placing area 27 by the customer and carried to the downstream side by the belt conveyor 24. When the article 26 passes the tunnel portion 28 and is detected by the CPU 202 via the height measuring apparatus 29 or video camera 30, the content of the first counter 46 is incremented (S2). In the tunnel portion 28, the height of the article 26 is first measured by the height measuring apparatus 29 and then an image of the article is obtained by the video camera 30.

After this, the operation of reading the bar code affixed on the article 26 is effected (S3). That is, the height, size and position of the article 26 are recognized based on information from the height measuring apparatus 29 and video camera 30, the focal distance, scanning pattern and direction of the bar code scanner 31 are determined and an effective area (position in which the bar code is present) of the article is scanned by the bar code scanner 31. Then, the bar code is read by the bar code scanner 31 and transferred to the POS terminal 200. At this time, the feature data of the article derived by the height measuring apparatus 29 and video camera 30 is transferred to the POS terminal 200. The comparing process with data of the data base in the RAM 206 is effected based on the transferred code and feature data of the article.

Next, when the article code is decoded in the reading and comparing process S3, the article code is registered into the work area of the RAM 206 (S4) and the content of the second counter 47 is incremented (S5). Then, the thus registered article is carried as a registered article 26*a* to the article stacker 32 by the belt conveyor 24 (S6).

On the other hand, if the the bar code of the article cannot be read and the decoding operation cannot be effected, an alarm signal is supplied to the remote terminal device 41 via the line 42 (S7). At the same time, the CPU 202 temporarily interrupts the operation of the belt conveyor 24. At this time, the remote terminal device 41 receives the alarm signal to sound a buzzer, light a lamp, or display caution on the monitor display 43, thereby informing the operator 45 of one of the checkout lanes in which an unregistered article caused by the impossibility of reading is present. After this, image data of the unregistered article is transferred to the remote terminal device 41 via the line 42 (S8). The remote terminal device 41 receives the image data and the image of the unregistered article is displayed on the monitor display 43. Then, the operator 45 recognizes the image of the article displayed on the monitor display 43 and operates the keyboard 44 to input the article name or article code of the displayed article and the information is transferred to the POS terminal 200 of the corresponding checkout lane via the line 42. As a result, the article code of the unregistered article is registered into the RAM 206 of the POS terminal 200 (S9). After the process of registering the unregistered article is effected, the content of the second counter 47 is incremented (S5) and the belt conveyor 24 is driven again (S6) to carry the article to the article stacker 32 as a registered article 26*a*.

The above steps S2 to S9 are repeatedly effected until the end button 34 is depressed by the customer 25. When the end button 34 is depressed, the content of the first counter 46 and the content of the second counter 47 are compared with each other after the process for registering all of the articles placed on the belt conveyor 24 is effected. If the content of the first counter 46 coincides with the content of the second counter 47, the CPU 202 determines that all of the articles have been registered and displays the total amount of money for the articles on the sub-total display 36 (S10). Further, the content of the second counter 47 is cleared.

Then, the settlement process, that is, cash registration process is effected (S11). More specifically, the customer 25 inserts the pre-paid card, credit card or cash into the automatic payment machine 37 to effect the payment process. In the case of settlement by cash, a change is calculated and a change is given, if any.

Next, the CPU 202 causes the receipt issuing machine 38 to print the article names, prices, and the number of registered articles and issue a receipt having the total amount printed thereon (S12).

After this, the locked state of the gate 40 is released to open the passage (S13). Next, for example, when the customer 25 passing through the gate 40 is detected by a photosensor and the customer 25 passes through the gate 40, the gate 40 is closed to block up the passage and is locked in this state (S14). Thus, a sequence of article registration control operations is ended, and the CPU 202 sets the initial condition so as to start the operation of the checkout lane for a next customer.

In the step S8 of transferring image data of the unregistered article to the remote terminal device 41, the remote terminal device 41 receives the image data and the image of the article is displayed on the monitor display 43, but an image obtained by processing the image and extracting feature data of the article may be displayed. Further, it is possible to first compare the feature data of the article with data of the data base and display a candidate of a corresponding article name.

Next, among the above sequence of processes, the comparing process by use of the data base is explained in more detail.

The data base is previously created by taking into consideration the conditions such as the position and inclination of the article 26 set when the customer 25 places the article 26 on the belt conveyor 24. That is, the data base is created by extracting a large number of feature data items such as the sizes (projected areas), shapes, and colors of all of the articles (in some cases, part of articles such as fresh foods may be excluded) by the image processing and registering the same.

The feature data of color is constructed by monochromatic data, color component data indicating red, green or blue, chromatic data representing hue, brightness and chroma, or other color data.

Figure 8:
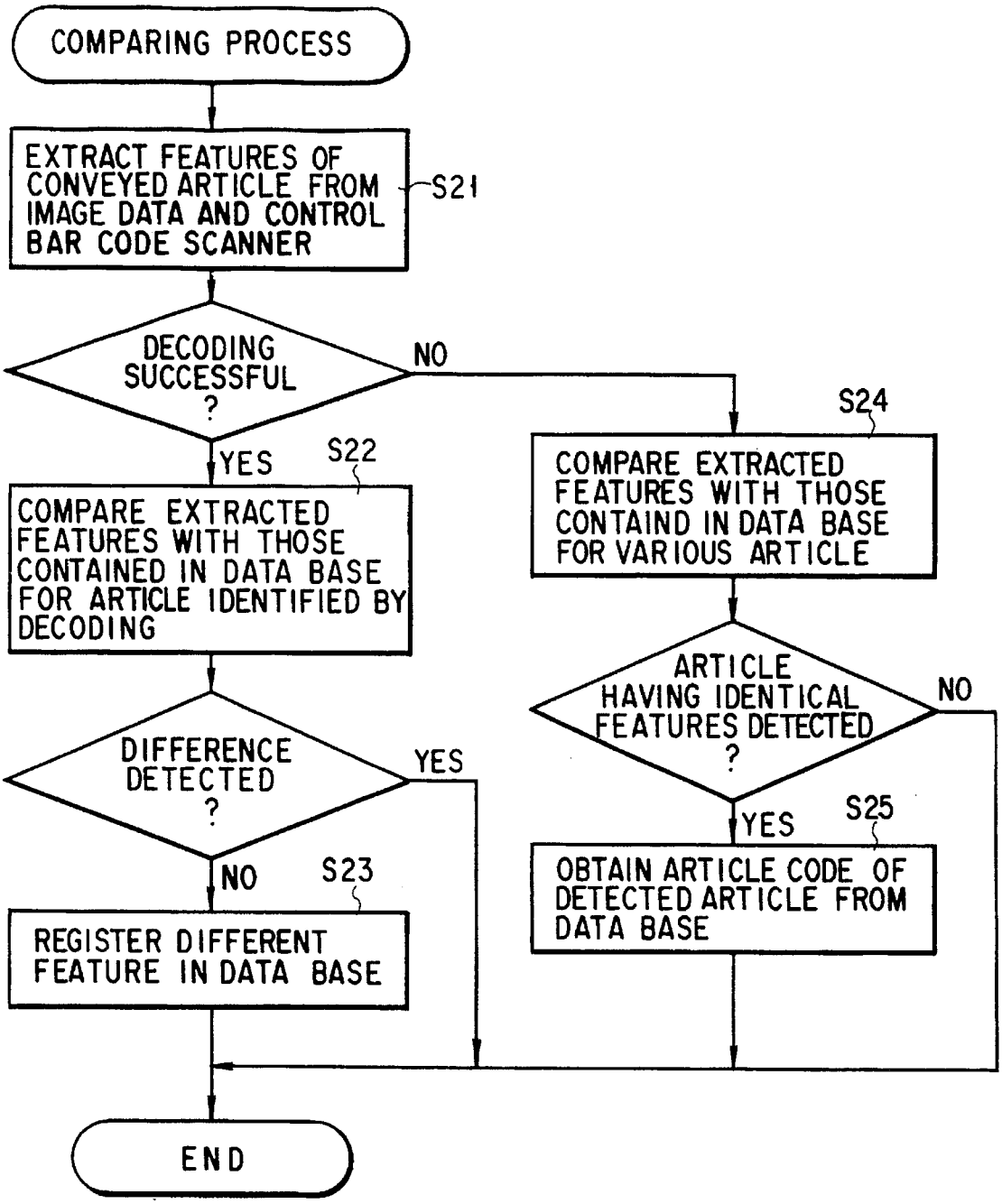
FIG. 8 is a flowchart for illustrating the data base comparing process by the POS terminal of the checkout lane shown in FIG. 2.

In the comparing process with the data base, as shown in FIG. 8, the feature data of the article 26 is extracted for each item such as the size and shape by first measuring the height of the article 26 carried by the belt conveyor 24 by use of the height measuring apparatus 29, obtaining an image of the article by the video camera 30 and subjecting the image to the image processing (S21).

When the bar code of an article is read by the bar code scanner 31 and the article code of the article is decoded, the feature data of the article corresponding to the decoded article code is derived from the data base and the comparing process with the feature data of the article subjected to the image processing in S21 is effected (S22). If it is detected in the comparing process that no feature data which coincides with or approximately equal to the corresponding feature data is present in the data base, the feature data is additionally registered as the feature data of the corresponding article of the data base (S23). If feature data which coincides with or approximately equal to the corresponding feature data is present, the comparing process is completed and the article whose article code is decoded is registered in S4 shown in FIG. 7.

On the other hand, if the bar code affixed on the article cannot be decoded, the feature data of the article obtained by the image processing is sequentially compared with feature data of all of the articles in the data base (S24). If it is detected in the comparing process that an article having a feature which is sufficiently similar to that represented by the feature data of the article is present in the data base, the article code of the article having the coincident feature data is read from the data base (S25). Then, the comparing process is terminated and the article is registered in S4 shown in FIG. 7 based on the readout article code.

Figure 7:
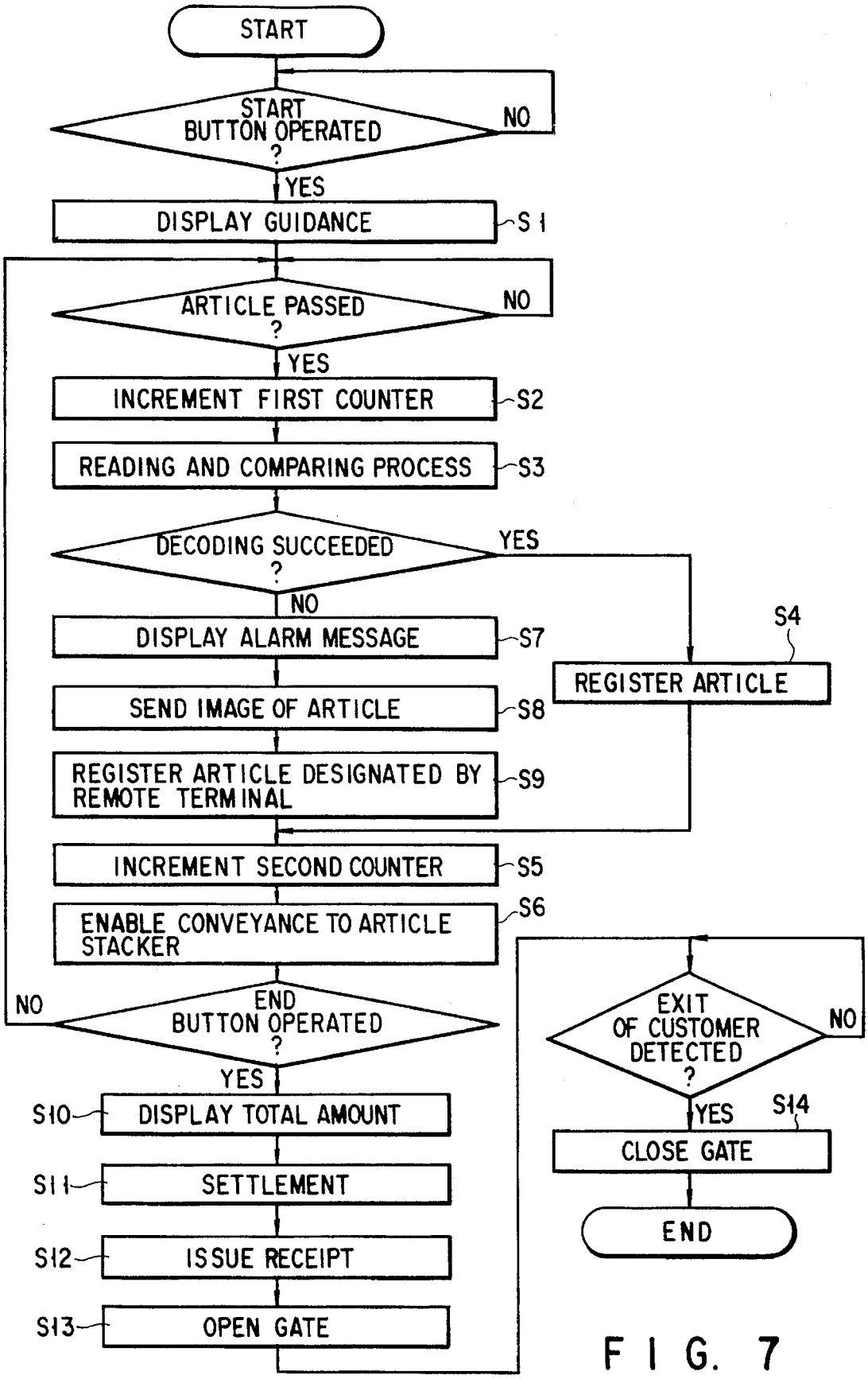
FIG. 7 is a flowchart for illustrating the operation of the checkout system shown in FIG. 2.

If no article having a feature which is sufficiently similar to that represented by the feature data of the article is present, the process is terminated, the article is treated as an unregistered article, an alarm signal is supplied to the remote terminal device 41 in S7 shown in FIG. 7, and image data of the article is transferred to the remote terminal device 41 in S8.

In the embodiment with the above construction, the customer 25 effects a sequence of operations for registration according to the following operation sequence.

First, the customer 25 goes to one end side of one of the checkout lanes, for example, the checkout lane 21-1 with the articles 26 received in the shopping basket 22. Then, the customer 25 places the shopping basket 22 on the basket placing table 23. At this time, the panel display 35 displays a message instructing the customer 25 to depress the start button 33 so as to start the checkout operation. Further, the same instruction is also given in a voice. If the customer 25 depresses the start button 33 according to the instruction, the belt conveyor 24 is driven. At this time, the content of the first counter is cleared.

Then, the customer 25 receives an instruction that the article 26 should be placed on the article placing area 27 with the bar code affixed to the article set to face upward or sideways according to the message displayed on the panel display 35 and the voice from the speaker 49. Therefore, the customer 25 takes out the articles 26 one by one from the shopping basket 22, and effects the operation of placing the article on the article placing area 27 after recognizing the position of the bar code. During this operation, the customer 25 receives an instruction that the end button 34 should be depressed after all of the articles 26 have been placed according to the message on the panel display 35 and the voice.

The article 26 placed on the belt conveyor 24 is carried to the tunnel portion 28. In the tunnel portion 28, the height of the article 26 is measured by the height measuring apparatus 29, an image of the article is obtained by the video camera 30, and the image of the article is subjected to the image processing by the CPU 202. At this time, the content of the first counter 46 is incremented.

After the height, size and position of the article 26 carried on the belt conveyor 24 are recognized by use of the height measuring apparatus 29 and video camera 30, the focal distance, scanning pattern and direction of the bar code scanner 31 are determined based on the above feature data and the bar code affixed on the article 26 is read by the bar code scanner 31. At the same time, the feature data of the article such as the shape and color is also derived based on the feature data obtained by use of the height measuring apparatus 29 and video camera 30.

When a decoded article code is output from the bar code scanner 31, the article code is compared with an article code of the data base in the POS terminal 200. Then, if a corresponding article code is present in the data base, feature data of the article corresponding to the article code is read from the data base and compared with feature data of the article which is subjected to the image processing. If the compared feature data items are coincident with each other or approximately equal to each other, the article registering process is effected based on the article data and the content of the second counter 47 is counted up.

Further, if the feature data items are not coincident with each other, the feature data of the article subjected to the image processing is additionally registered into the data base and the article registering process is effected based on the article data, and the content of the second counter 47 is counted up.

If the decoding operation in the bar code scanner 31 cannot be successfully effected, the feature data of the article which is subjected to the image processing is compared with the feature data items of all of the articles in the data base. If an article whose feature data is coincident with or approximately equal to the feature data of the article subjected to the image processing is detected, the article code of the article is read from the data base, the article registering process is effected based on the article code, and the content of the second counter 47 is counted up.

Further, if the compared feature data of the article is not coincident, the article is treated as an unregistered article and an alarm signal and the image data of the article are supplied to the remote terminal device 41 via the line 42. At this time, the CPU 202 provided in the POS terminal 200 temporarily interrupts the operation of the belt conveyor 24. In the remote terminal device 41, information that an unregistered article is present in the checkout lane 21-1 is given to the operator 45 by display and sound according to the alarm signal and the image of the unregistered article is displayed on the monitor display 43. The operator 45 recognizes the unregistered article by use of the monitor display 43 and inputs the article name or article code of the article by use of keys on the keyboard 44.

As a result, the POS terminal 200 of the checkout lane 21-1 effects the registering process for the unregistered article and counts up the content of the second counter 47. Then, it starts the belt conveyor 24 which has been interrupted.

The thus registered article **26*a* is carried by the belt conveyor 24 to the article stacker 32**.

Then, when the customer 25 has placed all of the articles 26 on the article placing area 27, the customer depresses the end button 34. As a result, a message displayed on the panel display 35 and the voice instruct the customer 25 to move towards the downstream side of the belt conveyor 24.

When the height of the final article 26 carried by the belt conveyor 24 is measured by the height measuring apparatus 29, the image of the article is obtained by the video camera 30 and the registering process is effected for the article, the content of the first counter 46 is compared with the content of the second counter 47, and if the contents of the counters are coincident with each other, the total amount of money for the customer is displayed on the sub-total display 36.

The customer 25 confirms the amount of money to be paid by observing the display content on the sub-total display 36 and inserts a pre-paid card into the automatic payment machine 37, for example. The automatic payment machine 37 terminates the payment process if the remainder of the pre-paid card is equal to or larger than the total amount of money. If the remainder of the pre-paid card is smaller than the total amount of money, the automatic payment machine 37 displays the deficient amount of money on the sub-total display 36. Therefore, the customer 25 pays the deficient amount of money by cash to the automatic payment machine 37. In this case, a change is given, if any.

When the automatic payment is thus completed, the receipt issuing machine 38 issues a receipt. At this time, the gate is released from the locked state. The customer 25 receives the receipt, passes through the gate and goes to the position of the article stacker 32. After the customer 25 passes through the gate 40, the gate 40 is closed again and locked.

The customer 25 puts the articles **26*a* on the registered article stacker 32** into a bag and leaves the store.

The checkout operation for articles by use of the checkout lane 21-1 is described above, but the same operation as described above is effected for the other checkout lanes 21-2, 21-3.

If an automatic bagging machine is provided on the registered article stacker 32, the bagging operation can be automatically effected without imposing any load on the customer.

Thus, registration of the article can be automatically effected by the operation of the customer 25 in each of the checkout lanes 21-1, 21-2, 21-3 and it is not necessary to station the cashier for registering articles and the operator for receiving cash or giving a change. Further, if an unregistered article is present in the checkout lane, the operator 45 stationed in front of the remote terminal device 41 registers the unregistered article.

Therefore, it becomes possible for one operator to manage a plurality of checkout lanes, thereby making it possible to significantly reduce the number of workers and register articles without passing an unregistered article. Further, a troublesome operation of using a partition rod for separating the customers from each other can be made unnecessary.

In the first embodiment, three checkout lanes are provided, but it is of course possible to change the number of checkout lanes according to the scale of the store so as to enhance the operation efficiency.

Next, a second embodiment of this invention is explained with reference to the accompanying drawings. Portions which are the same as those of the first embodiment are denoted by the same reference numerals and the detail explanation therefor is omitted.

Figure 9:
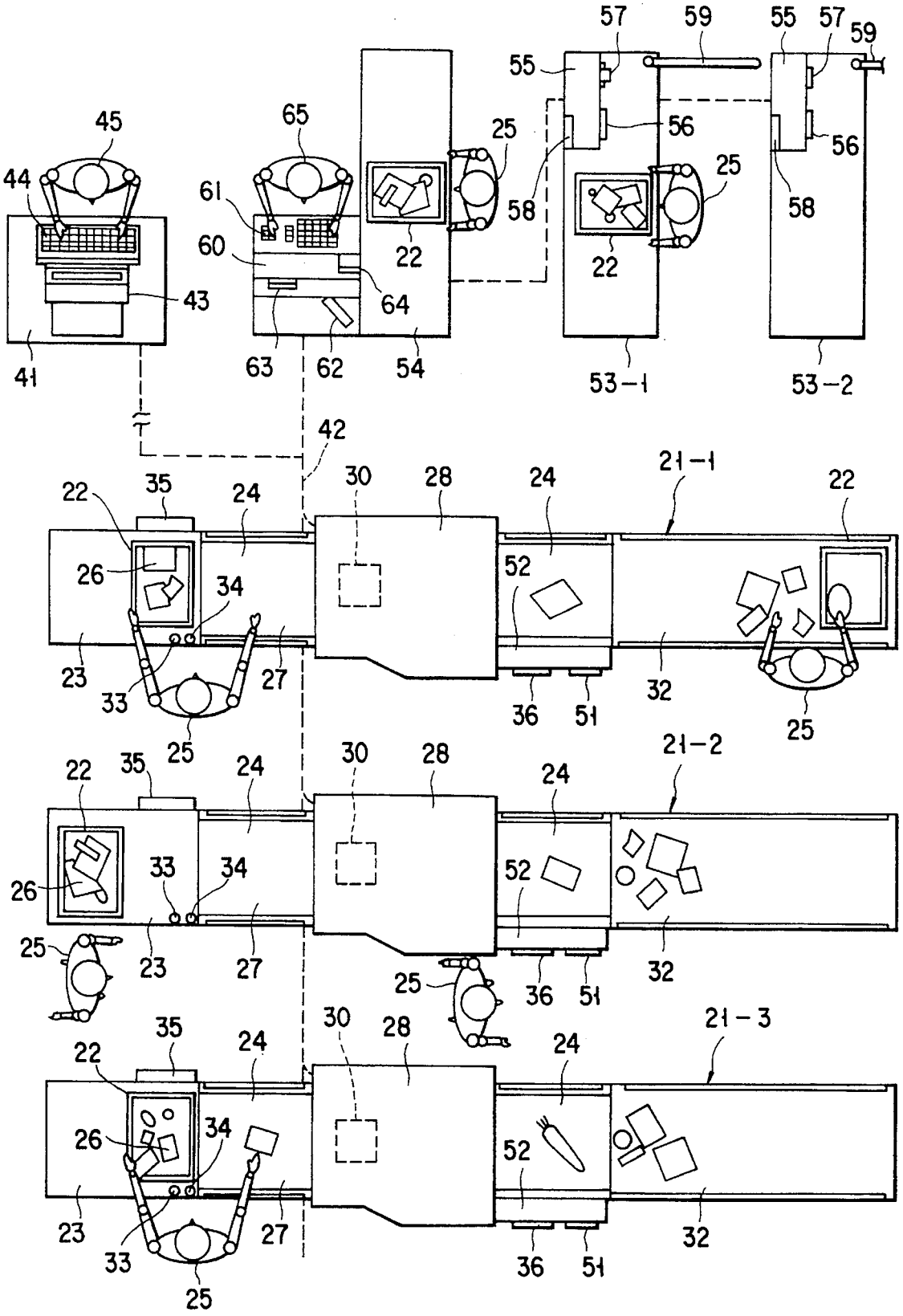
FIG. 9 is a whole construction view showing a second embodiment of a checkout system according to this invention.

FIG. 9 shows a checkout system according to the second embodiment of this invention. A card issuing unit 52 having a combination of a sub-total display 36 and a issuing machine 51 for issuing a number card (or number slip), for example, is used instead of the ATM 39 provided in each of the checkout lanes 21-1, 21-2, 21-3. No gate 40 is provided in each of the checkout lanes 21-1, 21-2, 21-3. As indicated by broken lines in FIG. 3, the card issuing unit 52 is connected to the POS terminal 200 of the first embodiment via an interface 230. For example, the number of the checkout lane, the number of the customer and the like are magnetically recorded on a number card issued from the issuing machine 51.

A plurality of automatic settlement counters, for example, two automatic settlement counters 53-1, 53-2 are disposed in position apart from the checkout lanes 21-1, 21-2, 21-3. For example, one cashier counter 54 may be disposed in parallel with the automatic settlement counters 53-1, 53-2.

Each of the automatic settlement counters 53-1, 53-2 has a settlement device 55. The settlement device 55 is constructed by integrally arranging an automatic payment machine 56 for effecting the automatic settlement process, a receipt issuing machine 57 for printing the article names and prices of the registered articles, the number of and the total amount for the registered articles and the like on paper by use of a printer and issuing a receipt, and a display 58. The automatic payment machine 56 has an insertion port into which a number card is inserted, an insertion port into which a pre-paid card, credit card or cash is inserted, and a change discharging port for giving back a change if the payment is made by cash and a change is made.

Each of the automatic settlement counters 53-1, 53-2 has a gate 59 for blocking up the passage of the customer. The gate 59 is normally set in a state to block up the passage and locked in this state. Only after the customer 25 has made the payment in the automatic payment machine 56 and the receipt issuing machine 57 has issued a receipt, the gate 59 is released from the locked state. After the customer 25 passes through the gate 59 which is released from the locked state, the gate 59 is set in a state to block up the passage again and locked in this state.

A cash register 60 operated by a cashier 65 is arranged on the side portion of the cashier counter 54. The cash register 60 includes a keyboard 61, cashier display 62, customer display 63 and receipt issuing machine 64 containing a printer. An insertion port (not shown) into which a number card is inserted is provided in the cash register 60.

The settlement device 55 of each of the automatic settlement counters 53-1, 53-2 and the cash register 60 of the cashier counter 54 are connected to each of the checkout lanes 21-1, 21-2, 21-3 via a line 42.

Figure 10:
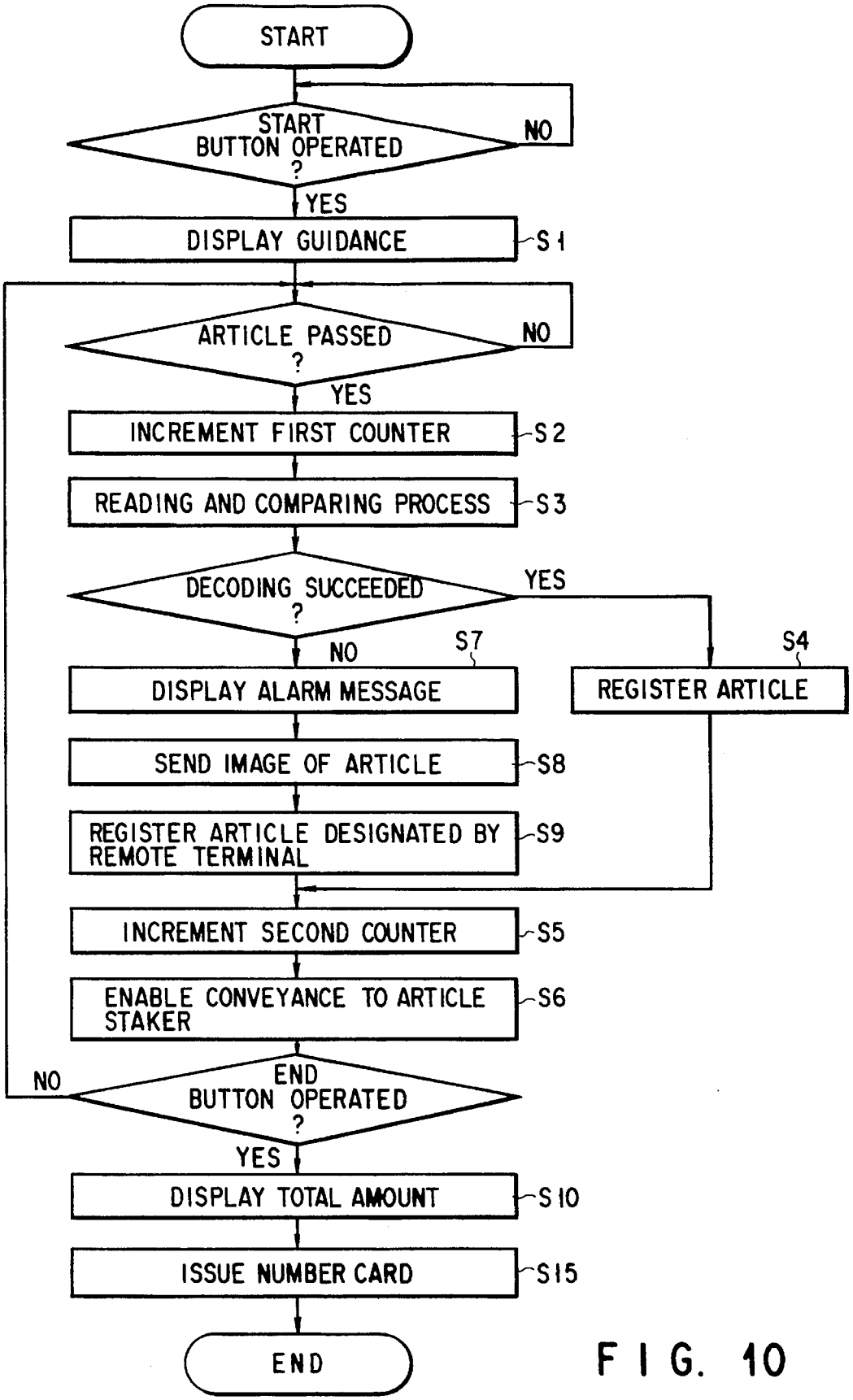
FIG. 10 is a flowchart for illustrating the operation of the checkout system shown in FIG. 9.

As shown in FIG. 10, the checkout process by the POS terminal 200 provided in the checkout lane is the same as the checkout process of the first embodiment in the process up to the step (S10) of displaying the total amount of articles on the sub-total display 36. In the second embodiment, after the total amount for the customer is displayed on the sub-total display 36 in S10, the issuing machine 51 issues a number card having the number of the checkout lane, the number of the customer and the like magnetically recorded thereon (S15).

Figure 11:
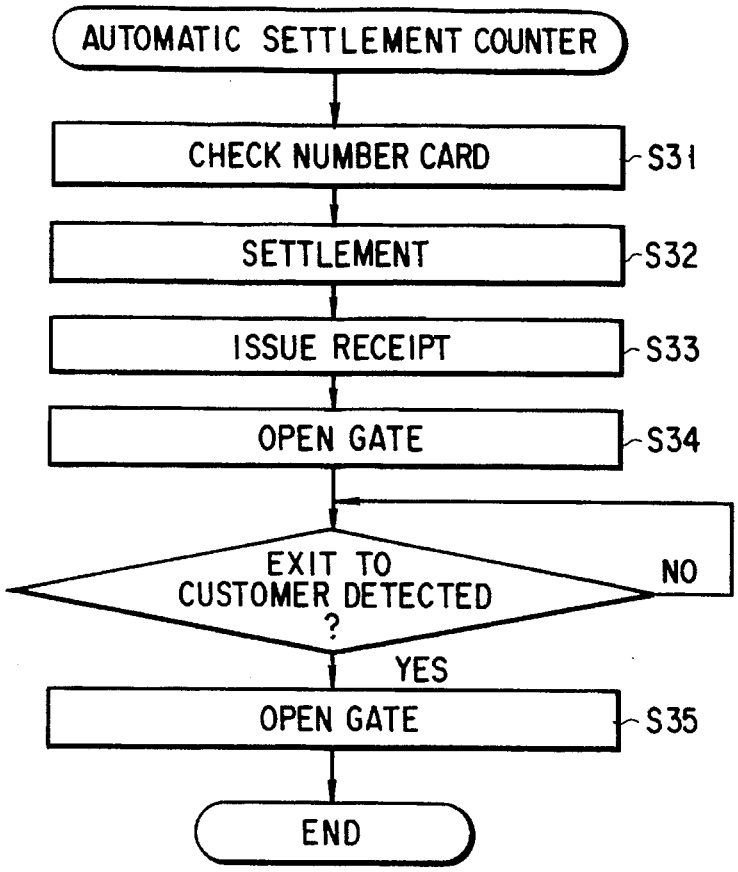
FIG. 11 is a flowchart for illustrating the processing operation of an automatic settlement counter shown in FIG. 9.

In each of the automatic settlement counters 53-1, 53-2, as shown in FIG. 11, if a number card is inserted into the settlement device 55, magnetic information recorded on the number card is read and an inquiry is made to the POS terminal 200 of the corresponding checkout lane to check whether the information is correct or not (S31). Next, if the information recorded on the number card is correct, the total amount for the corresponding customer is received from the POS terminal 200 of the corresponding checkout lane and displayed on the display 58.

Then, the settlement process, that is, cash registration process is effected (S32). The process is effected by inserting a pre-paid card, credit card or cash into the automatic payment machine 56 according to the total amount for the articles displayed on the display 58 and effecting the payment process. In the case of settlement by cash, a change is calculated and a change is given back from the change discharging port, if any.

When the cash registration process is completed, a receipt having the article names and prices of the registered articles, the number of the articles and the total amount printed thereon is issued from the receipt issuing machine 57 (S33). Then, the locked state of the gate 59 is released to open the passage (S34).

Next, when the customer 25 passing through the gate 59 is detected by a photosensor, for example, and the customer 25 has passed through the gate, the gate 59 is set into a closed state to block up the passage and locked in this state (S35). Thus, a sequence of article registration control operations is completed.

Figure 12:
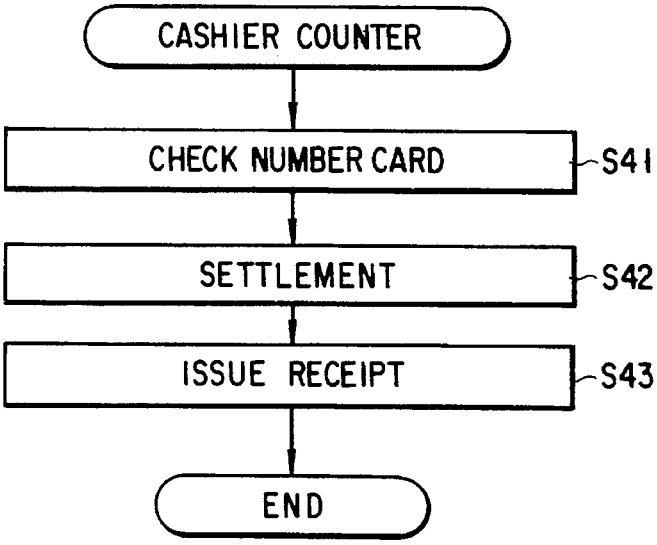
FIG. 12 is a flowchart for illustrating the processing operation of a cashier settlement counter shown in FIG. 9.

As shown in FIG. 12, when a number card is inserted, the cash register 60 of the cashier counter 54 reads magnetic information recorded on the number card and makes an inquiry to the POS terminal 200 of the corresponding checkout lane to check whether the information is correct or not (S41). Next, if the information recorded on the number card is correct, the total amount for the corresponding customer is received from the POS terminal 200 of the corresponding checkout lane and displayed on the displays 62, 63.

Then, the settlement process, that is, cash registration process is effected (S42). The process is effected by the operation of the customer of recognizing the total amount and paying cash to the cashier 65 and the operation of the cashier 65 of inputting the amount of received cash by use of the keyboard 61.

When the cash registration process is completed, a receipt having the article names and prices of the registered articles, the number of the articles and the total amount printed thereon is issued from the receipt issuing machine 64 (S43). The receipt is handed over from the cashier 65 to the customer 25.

In the second embodiment, the customer 25 effects a sequence of article registration operations according to the following operation procedure.

The operation procedure is the same as that of the first embodiment in the process effected until the customer 25 depresses the end button 34 after placing all of the articles 26 on the article placing area 27 and recognizes the total amount displayed on the subtotal display 36.

The customer 25 recognizes the total amount displayed on the sub-total display 36 and receives a number card issued from the issuing machine 51. Then, the customer 25 puts the registered articles **26*a* carried to the article stacker 32 into the shopping basket 22** again and goes to the automatic settlement counter or cashier counter.

In a case where the customer 25 goes to the automatic settlement counter 53-1, 53-2 for the settlement process, the customer inserts his number card. Then, since the total amount is displayed on the display 58, the customer 25 recognizes the to-be-paid total amount displayed on the display 58 and inserts a pre-paid card into the automatic payment machine 56. The automatic payment machine 56 terminates the settlement process if the remainder of the pre-paid card is equal to or larger than the total amount. If the remainder of the pre-paid card is smaller than the total amount, the automatic payment machine 56 displays the deficient amount of money on the sub-total display 58. Therefore, the customer 25 pays the deficient amount of money by cash to the automatic payment machine 56. In this case, a change is given, if any.

When the automatic settlement is thus completed, the receipt issuing machine 57 issues a receipt. At this time, the gate 59 is released from the locked state. The customer 25 receives the receipt and passes through the gate 59. After the customer 25 passes through the gate 59, the gate 59 is closed again and locked. The customer 25 puts the articles in the shopping basket 22 into a bag and leaves the store.

On the other hand, in a case where the customer 25 goes to the cashier counter 54, the customer hands his number card over to the cashier 65. The cashier 65 inserts the received number card into the insertion port of the cash register 60. As a result, since the total amount is displayed on the displays 62, 63, the customer pays cash to the cashier 65 according to the to-be-paid amount displayed on the display 62.

The cashier 65 inputs the amount of received cash by use of the keys on the keyboard 61. At this time, a change is displayed on the displays 62, 63, if any. Further, a receipt is issued from the receipt issuing machine 64.

The cashier 65 hands the change and receipt over to the customer 25. The customer 25 receives the change and receipt, puts the articles in the shopping basket 22 into a bag and then leaves the store.

In the second embodiment, the same effect as in the first embodiment can be attained.

In the checkout system of the second embodiment, it is not always necessary to set the number of checkout lanes equal to the number of settlement counters, and it is possible to set an adequate number of checkout lanes and payment counters so as to enhance the operation efficiency according to the relation between time required for the article registering operation in the checkout lane and time required for the payment in the payment counter.

In the first and second embodiments, the height measuring apparatus having two support poles on which a plurality of light emitting elements 103, - - - and a plurality of light receiving elements 104, - - - are arranged in opposite positions at a preset pitch is used, but this is not limitative.

Figure 13:
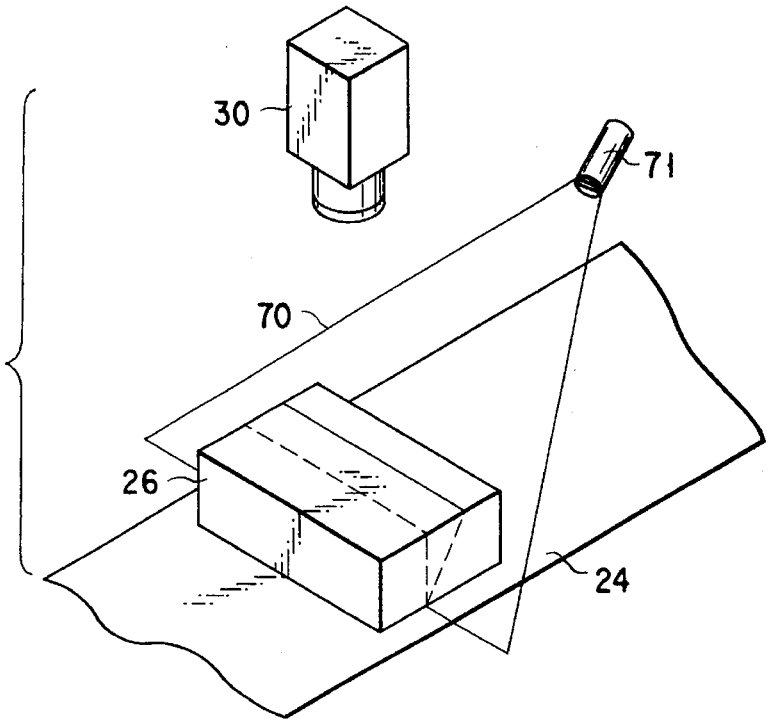
FIG. 13 is a perspective view showing an embodiment of another height measuring apparatus which can be applied to this invention.
Figure 14:
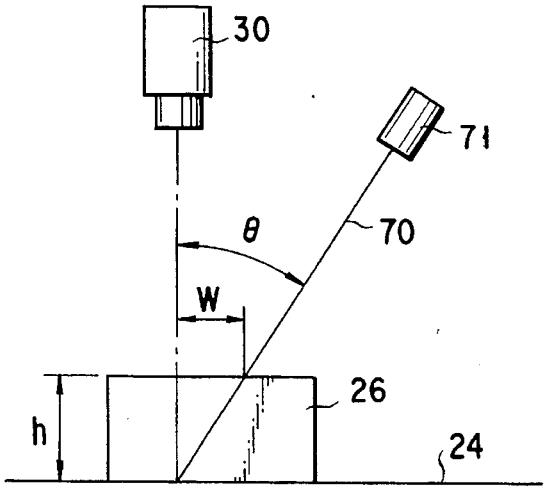
FIG. 14 is a side view of the height measuring apparatus shown in FIG. 13.
Figure 15:
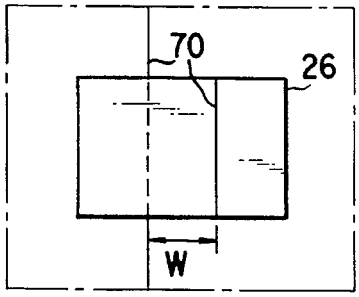
FIG. 15 shows one example of a 2-dimensional image obtained by a video camera when the height measuring apparatus shown in 13 is used.

For example, a height measuring apparatus shown in FIG. 13 has a light source 71 for emitting slit light 70 in an oblique direction with respect to the article 26 and a video camera 30 to measure the height of the article by the light-section method. That is, as shown in FIG. 14, if the slit light 70 is inclined at a preset angle θ with respect to the central axis of the video camera 30, the distance w between a line formed of the slit light 70 projected on the upper surface of the article 26 and a line formed of the slit light 70 projected on the belt conveyor 24 varies with the height of the article 26. In other words, the height h of the article 26 can be represented by $h=w/\tan\theta$. As shown in FIG. 15, the value of the distance w can be derived from a 2-dimensional image obtained by the video camera 30 and the height h of the article 26 can be calculated by use of the value of the distance w.

Not only the height of the article 26 can be measured but also the position and shape of the article 26 can be detected based on the 2-dimensional image of the slit light 70 by the height measuring apparatus shown in FIG. 13. Further, according to the height measuring apparatus, the height of the article 26 can be more precisely measured in comparison with the case of each of the embodiments, and therefore, the variable scanning optical systems 106, 107, 108 of the bar code scanner 31 can be more precisely adjusted. As a result, the reading process by the bar code scanner can be more stably effected. Further, it is possible to estimate a 3-dimensional image of the article carried by the belt conveyor 24 based on the 2-dimensional image of the slit light 70. Therefore, the article can be more reliably designated by use of a data base including the 3-dimensional image data.

Figure 16:
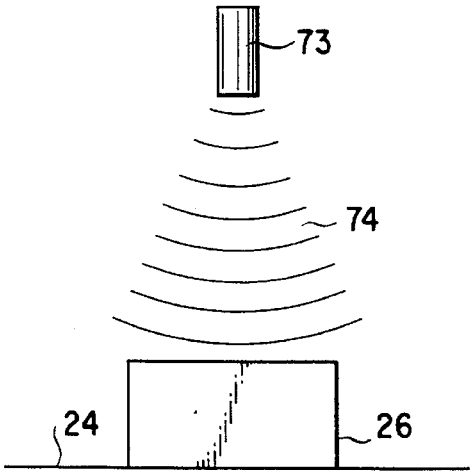
FIG. 16 is a side view showing another embodiment of the height measuring apparatus which can be applied to this invention.

Further, a height measuring apparatus shown in FIG. 16 may be used in each of the first and second embodiments. The height measuring apparatus includes an ultrasonic sensor head 73. An ultrasonic wave 74 is radiated from the ultrasonic sensor head 73 towards the belt conveyor 24 and the height of the article 26 is measured based on the phase difference between the radiated ultrasonic wave 74 and the ultrasonic wave reflected from the upper surface of the article 26.

Further, in the first and second embodiments, a height measuring apparatus in which a plurality of light emitting elements and a plurality of light receiving elements are arranged on one of two support poles and a reflection plate is disposed on the other support pole to face the light emitting elements may be used. According to the height measuring apparatus, the height of an article passing through between the two support poles is measured based on a variation in the light receiving condition of the light receiving elements which receive lights emitted from the light emitting elements and reflected from the reflection plate. Further, the height of an article passing through between the two support poles may be measured by arranging the light receiving elements to receive reflected lights reflected from the article.

Further, in the first and second embodiments, the first and second counters 46 and 47 are provided in preset areas of the RAM 206 connected to the CPU 202. However, as in the above embodiments, if the content of the second counter 47 is cleared and the number of registered articles of a next customer is counted after the article registration for the preceding customer has been completed, there occurs a possibility that the article registration for the next customer is started before the article registration of the preceding customer is not yet completed, for example, and in such a case, it becomes impossible to use the second counter 47. In order to cope with this case, it is possible to provide a counter 3 in a different area of the RAM 206 so as to use the counter 3 instead of the second counter 47 when it becomes impossible to use the second counter 47.

Further, the first and second counters 46 and 47 can be constructed by one up-down counter. That is, when the passage of the article is detected by means of the height measuring apparatus 29 and video camera 30, the content of the up-down counter is counted up, and when the article is registered by the reading/comparing process, the content of the up-down counter is counted down. When the content of the up-down counter is set to "0" after the end button 34 is depressed, the CPU 202 determines that the article registration for the customer is completed. In this case, by using an additional up-down counter, it becomes possible to cope with a case wherein the registration for a next customer is started before the registration for the preceding customer is completed.

Further, in the first and second embodiments, the belt conveyor is used as a carrying device for carrying articles, but this is not limitative. For example, a pallet type carrying device or roller conveyor type carrying device can be used.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A checkout system having a checkout lane comprising:

carrying means for carrying articles in one direction;

image obtaining means for obtaining an image of an article which is being carried by said carrying means;

reading means for reading out a bar code affixed to an article which is being carried by said carrying means;

registering means for recognizing the article on the basis of one of (i) the bar code read out by said reading means, and (ii) physical features of the article which are included in the article image obtained by said image obtaining means, and then automatically registering the article;

instruction inputting means for inputting a start and an end instruction of article registration;

counting means for counting a number of articles conveyed into a predetermined area after the start instruction is input by said inputting means and for counting a number of articles which have been registered; and completion detecting means for detecting completion of article registration by confirming that the numbers of conveyed articles and registered articles counted by said counting means coincide with each other after the end instruction is input by said instruction inputting means.

2. A checkout system according to claim 1, wherein:

said checkout lane further comprises height measuring means for measuring a height of the article which is being carried by said carrying means, and means for outputting a value of the height of the article as a physical feature of the article to said registering means; and said registering means recognizes the article on the basis of the value of the height of the article which is output from said height measuring means and the physical features of the article which are included in the article image obtained by said image obtaining means, and then automatically registers the article.

3. A checkout system according to claim 1, wherein said image obtaining means includes a video camera, which is located just above said carrying means, for imaging the article which is being carried by said carrying means.

4. A checkout system according to claim 2, wherein said image obtaining means includes a video camera, which is located just above said carrying means, for imaging the article which is being carried by said carrying means.

5. A checkout system according to claim 2, wherein:

said reading means includes code reading means having a variable scanning optical system for optically reading out the bar code affixed to the article; and the variable scanning optical system is adjusted on the basis of the article image obtained by said image obtaining means and the height of the article measured by said height measuring means.

6. A checkout system according to claim 5, wherein said image obtaining means includes a video camera, which is located just above said carrying means, for imaging the article which is being carried by said carrying means.

7. A checkout system according to claim 1, wherein said registering means includes image processing means for processing an article image obtained by said image obtaining means to extract physical features of the article.

8. A checkout system according to claim 2, wherein said registering means includes image processing means for processing an article image obtained by said image obtaining means to extract physical features of the article.

9. A checkout system according to claim 8, wherein said registering means includes:

memory means for storing data regarding features of articles in advance;

comparing means for comparing the physical features of the article extracted by said image processing means and the height of the article measured by said height measuring means with the data stored in said memory means; and identifying mans for identifying the article on the basis of the bar code read out by said code reading means; and wherein said registering means recognizes the article by at least one of (i) a comparison process of said comparing means and (ii) an identification process of said identification means, and then automatically registers the article, and wherein the comparison process of said comparing means is performed on the basis of the physical features of the article, and the identification process of said identifying means is performed on the basis of the bar code.

10. A checkout system according to claim 1, further comprising:

settlement means for performing a settlement process based on a total price of articles each of which is registered by said registering means; and a gate unit which is included in said settlement means, and which is opened when the settlement process is completed, said settlement means and said gate unit being arranged apart from said checkout lane.

11. A checkout system according to claim 10, wherein said settlement means is disposed in said checkout lane.

12. A checkout system according to claim 10, wherein said checkout lane includes card issuing means for issuing a card on which customer number data and number data of the checkout lane in which the article is registered are recorded, and said settlement means for displaying the total price for registered articles and effecting the settlement process based on data recorded on the card is disposed at a position apart from said checkout lane.

13. A checkout system according to claim 10, wherein said settlement means includes sub-total display means for displaying the total price for registered articles, automatic payment means for effecting the a payment process based on the total price displayed on said sub-total display means, and receipt issuing means for issuing a receipt after the payment process by said automatic payment means is completed.

14. A checkout system comprising:

a checkout lane including carrying means for carrying articles in one direction, feature extraction means for extracting a feature of an article carried by said carrying means, and article registering means for recognizing and registering an article based on the feature of the article extracted by said feature extraction means; and a remote terminal device disposed at a position apart from said checkout lane, for displaying a feature of an article which cannot be recognized by said article registering means of said checkout lane and permitting an article having the displayed feature to be designated by a key input operation;

said article registering means including auxiliary registering means for registering an article designated by said remote terminal device; and said checkout lane includes instruction inputting means for inputting a start and an end instruction of article registration, counting means for counting a number of articles which is conveyed into a predetermined area after the start instruction is input by said inputting means and for counting a number of articles which have been registered, and completion detecting means for detecting completion of article registration by confirming that the numbers of conveyed articles and registered articles counted by said counting means coincide with each other after the end instruction is input by said instruction inputting means.

* * * * *